United States Patent [19]

Lindquist

[11] Patent Number: 4,582,000

[45] Date of Patent: Apr. 15, 1986

[54] TRAIN OF DRIVERLESS VEHICLES

[75] Inventor: Per E. Lindquist, Easton, Pa.

[73] Assignee: SI Handling Systems, Inc., Easton, Pa.

[21] Appl. No.: 564,063

[22] Filed: Dec. 21, 1983

[51] Int. Cl.[4] ..... B61B 13/00

[52] U.S. Cl. ..... 104/166

[58] Field of Search ..... 104/166; 105/168, 176

[56] References Cited

U.S. PATENT DOCUMENTS 760,084 5/1904 Steele ..... 105/176

2,127,868 8/1938 Huffman ..... 105/168

3,818,837 6/1974 Jacoby ..... 104/166

*Primary Examiner*—Leonard E. Smith

*Attorney, Agent, or Firm*—Seidel, Gonda, Goldhammer & Abbott

[57] ABSTRACT

A plurality of driverless vehicles are pivotably connected together to form a train. Each vehicle has a drive wheel connected to the drive wheel on the next adjacent vehicle by a flexible member extending therebetween so that the drive wheel on the second vehicle is a slave to the drive wheel on the first vehicle.

8 Claims, 3 Drawing Figures

FIG. 1
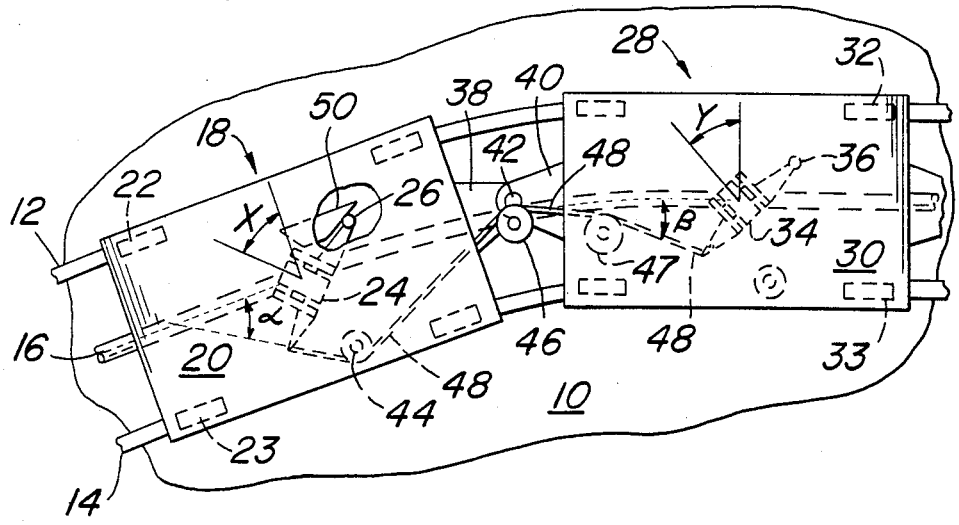
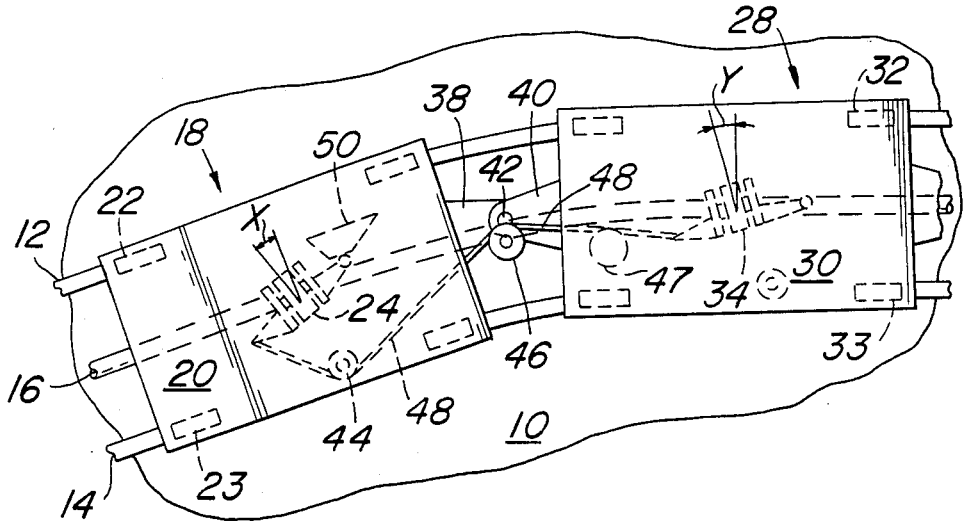
FIG. 2

TRAIN OF DRIVERLESS VEHICLES

BACKGROUND OF THE INVENTION

Driverless vehicles of the general type involved herein are disclosed in U.S. Pat. No. 3,356,040. As disclosed in said patent, a driverless vehicle is propelled along tracks by frictional contact between a rotating drive shaft and a drive wheel on the vehicle.

When the load on such a driverless vehicle is light, only one drive wheel is adequate. For larger loads, it is known to provide two drive wheels on a vehicle with the drive wheels being connected together. For example, see U.S. Pat. No. 4,347,792. Curves in the tracks has caused some concern in connection with such driverless vehicles. For example, see U.S. Pat. No. 4,389,943 which discloses a set of bogies on the driverless vehicle so that it may negotiate curves without a jerky motion. It is known to control the speed of such a driverless vehicle by providing a speed control device usually in the form of a cam for cooperation with a cam follower attached to the drive wheel. For example, see U.S. Pat. No. 4,348,961.

The present invention is directed to solution of the problem of how to provide a train of such driverless vehicles. A train of such driverless vehicles differs from a conventional train in that each vehicle is separately propelled by contact between its drive wheel and the drive shaft associated therewith. If it is desired to cause the train to stop with the support wheels of the lead vehicle on a curve and one or more of the remaining cars on a straight section of the track, it has been found necessary to interconnect the drive wheels on the vehicles of the train with a flexible member.

SUMMARY OF THE INVENTION

The present invention is directed to a train of driverless vehicles which are pivotably connected to each other. Each vehicle has support wheels for riding on a track and has a drive wheel which is adapted to be in frictional contact with a drive shaft. A flexible member extends around an idler pulley on each vehicle and has its ends connected to the drive wheels so that the drive wheel of a second vehicle is a slave to the drive wheel of the lead vehicle.

Various objects and advantages of the present invention will appear hereinafter.

For the purpose of illustrating the invention, there is shown in the drawings a form which is presently preferred; it being understood, however, that this invention is not limited to the precise arrangements and instrumentalities shown.

FIG. 1 is a plan view of a train of vehicles in accordance with the present invention.

FIG. 2 is a view similar to FIG. 1 but showing the lead vehicle stopped along a curved portion of the tracks.

DETAILED DESCRIPTION

Figure 3:
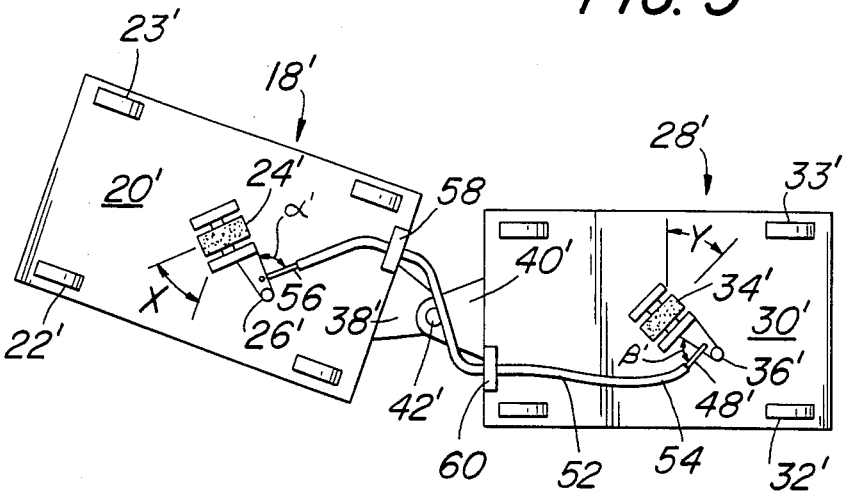
FIG. 3 is a bottom view of a train in accordance with another embodiment.

Referring to the drawing in detail, wherein like numerals indicate like elements, there is shown a floor 10 having a pair of tracks 12, 14 supported thereby. The tracks may have a straight section along the right hand end of the figures and which merges into a curved section as shown along the left hand end of the figures. A drive shaft 16 is disposed between the tracks and is driven by a motor not shown so as to rotate about its longitudinal axis. It is known to provide such drive shaft in segments connected end to end.

A train of driverless vehicles is provided with the lead vehicle 18 pivotable connected to vehicles therebehind. For purposes of illustration of the invention, only two vehicles are shown. Vehicle 18 includes a horizontally disposed body having an upper support surface for supporting a load. Body 20 has a set of support wheels 22 on one side for riding on track 12 and a set of support wheels 23 on the opposite side for riding on track 14.

The body 20 supports a drive wheel 24 which is spring biased to a drive position. Wheel 24 is in frictional contact with drive shaft 16 and rotates about a horizontal axis. The mount which supports drive wheel 24 may oscilate about a vertical axis between a drive position and a stop position. The mount for drive wheel 24 includes an arm terminating in a cam follower 26.

The second vehicle of the train is designated 28. Vehicle 28 is identical with vehicle 18 and includes a similar body 30 having support wheels 32 on one side for riding along track 12 and support wheels 33 on the opposite side for riding along track 14. The drive wheel of vehicle 28 is designated 34 and its cam follower is designated 36. A bracket 38 extending rearwardly from body 20 is pivotably connected to a bracket 40 which extends forwardly from the body 30. The brackets 38 and 40 are pivotably connected at pivot 42.

An idler pulley 44 is supported by the body 20. Another idler pulley 46 is supported by the bracket 40 on vehicle 28 adjacent to pivot 42. A flexible member 48 is connected at its ends to the support mounts for the drive wheels 24 and 34. Member 48 is trained around the idler pulleys 44, 46, and 47 so that drive wheel 34 is a slave to drive wheel 24. Pulley 46 is located so that member 48 passes over the center of pivot 42. In this regard, it will be noted that angle X associated with vehicle 18 will always equal angle Y associatd with vehicle 28. Member 48 should be flexible so that it may be trained around the idler pulleys 44, 46 and 47 but should not be elastic. Member 48 is preferably a metal wire but may be made of cable, rope, chain, leather, etc. A bracket corresponding to bracket 38 extends from the rear end of body 30. Also, an idler pulley is provided on the body 30 comparable to idler pulley 44.

In order that that train may be caused to halt along a curved portion of the tracks 12, 14, with one or more or the vehicles on the curved portion and one or more vehicles on the straight portion of the tracks, there is provided a speed control device 50 between the tracks 12 and 14. Device 50 may be of conventional construction in the form of a cam with a motor for moving the cam to an inoperative position when it is desired to permit the train to commence movement. The cam is positioned so as to be contacted by the cam follower 26 and move the drive wheel 24 to an accumulation position. As drive wheel 24 and its support mount oscilate above a vertical axis, angle X decreases. Due to the member 48, drive wheel 34 also oscilates in the same direction by the same amount so that angle Y decreases by the same amount.

Any turning movement imposed on drive wheel 24 due to contact between device 50 and cam follower 26 will cause member 48 to pull drive wheel 34 to oscillate it by the same amount. When cam follower 26 looses contact with device 50, the spring bias on the drive wheels 24, 34 returns them to their drive position. Pulley 47 is located on vehicle 28 so that the included angle alpha between the center line of vehicle 18 and that portion of member 48 extending from drive wheel 24 equals included angle beta between the center line of vehicle 28 and that portion of member 48 extending from drive wheel 34.

In FIG. 3 there is shown another embodiment wherein corresponding elements are identified with corresponding primed numerals. A wire 48' is attached at its ends to the mount for drive wheels 24' and 34'. A flexible sheath 52 surrounds member 48' and is fixed thereto at its ends 54, 56. The sheath 52 extends through guide loop 58, 60 but need not extend over the pivot 42'. Member 48' and its sheath 52 are similar to the elements used to operate the throttle on a motor bike. Member 48' enables drive wheel 24' to control drive wheel 34' by a push or pull motion.

Heretofore, it has been conventional to provide speed control devices only along straight sections of an endless conveyor. It was not appreciated that driverless vehicles could be coupled together into the form of a train with speed control being accomplished by simply innerconnecting drive wheels on adjacent vehicles by a flexible member so that the second and subsequent vehicles have drive wheels which are a slave to the drive wheel on the lead vehicle. Thus, it will be seen that the objects of the present invention are accomplished in a manner which is simple, inexpensive, and reliable.

The present invention may be embodied in other specific forms without departing from the spirit or essential attributes thereof and, accordingly, reference should be made to the appended claims, rather than to the foregoing specification, as indicating the scope of the invention.

I claim:

1. Apparatus comprising a train of driverless vehicles, each vehicle having support wheels adapted to ride on tracks and a drive wheel adapted to be in frictional contact with a drive shaft, a connector member on a rear end of a lead vehicle being pivotably connected to a mating connector member on the front end of a second vehicle, each drive wheel including a mount supporting a cam follower for causing the mount to pivot about a vertical axis while the drive wheels rotate about a horizontal axis, at least one idler pulley on each vehicle, a flexible member trained around said idler pulleys, said flexible member being non-resilient, said flexible member having one end connected to the mount for the drive wheel on the lead vehicle and having its other end connected to the mount for the drive wheel on the second vehicle, one of said pulleys being adjacent said pivot, and each of said drive wheels being biased to a drive position.

2. Apparatus comprising a train of driverless vehicles, each vehicle having support wheels adapted to ride on tracks and a drive wheel adapted to be in frictional contact with a drive shaft, a connector member on a rear end of a lead vehicle being pivotably connected to a mating connector member of the front end of a second vehicle, each drive wheel including a mount supporting a cam follower for causing the mount to pivot about a vertical axis while the drive wheels rotate about a horizontal axis, a flexible non-resilient wire member, said flexible member having one end connected to the mount for the drive wheel on the lead vehicle and having its other end connected to the mount for the drive wheel on the second vehicle, said flexible member causing a pivoting action of said mount of said second vehicle corresponding to the pivoting motion of said mount of said lead vehicle and said drive wheel of said lead vehicle being biased to the drive position.

3. Apparatus in accordance with claim 2 wherein said flexible member is fixed to the ends of a sheath through which said member extends.

4. Apparatus comprising a train of driverless vehicles having support wheels adapted to ride on a pair of tracks, each vehicle having a drive wheel adapted to be in frictional engagement with a drive shaft rotating about its longitudinal axis, means pivotably connecting the rear end of one vehicle with the front end of an adjacent vehicle, and means coupling the drive wheel of the lead vehicle in the train in a master-slave relationship with the drive wheel of a second vehicle there behind whereby the drive wheel of the second vehicle is a slave to the drive wheel to the first vehicle.

5. Apparatus in accordance with claim 4 including a pair of tracks in rolling contact with said support wheels, said tracks having a curved section, a traffic control device along said curved section, said traffic control device being arranged to oscillate a support for said drive wheel on said lead vehicle to decrease the speed of the lead vehicle.

6. Apparatus in accordance with claim 4 wherein said last mentioned means is a sheathed wire having its ends connected to support mounts for said drive wheels.

7. Apparatus in accordance with claim 4 wherein said last-mentioned means includes at least one idler pulley on each vehicle, a flexible member trained around the idler pulleys and connected to support mounts for said drive wheels.

8. Apparatus in accordance with claim 7 wherein the idler pulley on the second vehicle is supported adjacent the pivot means between said vehicles.

* * * * *